US005556055A

United States Patent [19]

Lindstrand

[11] Patent Number: 5,556,055

[45] Date of Patent: Sep. 17, 1996

[54] DISPOSABLE DRUM WITH FRICTION FIT COMPONENTS

[75] Inventor: Ulf Lindstrand, Fengersfors, Sweden

[73] Assignee: Ulvator AB, Enkoping, Sweden

[21] Appl. No.: 155,637

[22] Filed: Nov. 22, 1993

[51] Int. Cl.[6] ..... B65H 75/14; B65H 75/18

[52] U.S. Cl. ..... 242/608.2; 242/118.61

[58] Field of Search ..... 242/608, 608.2, 242/608.3, 118.6, 118.61, 118.62

[56] References Cited

U.S. PATENT DOCUMENTS

| | | | |
|---|---|---|---|
| 864,063 | 8/1907 | Bauer | 242/118.61 |
| 1,243,102 | 10/1917 | Reid . | |
| 1,846,397 | 2/1932 | Kennedy | 242/118.62 |
| 2,704,642 | 3/1955 | Harris et al. | 242/118.6 |
| 3,317,160 | 5/1967 | Laird . | |
| 3,940,085 | 2/1976 | Campbell | 242/608.2 |
| 4,012,009 | 3/1977 | O'Malley et al. | 242/118.62 |
| 4,471,919 | 9/1984 | Leunig | 242/608.2 |

FOREIGN PATENT DOCUMENTS

| | | | |
|---|---|---|---|
| 658216 | 4/1965 | France . | |
| 2223994 | 10/1974 | France . | |
| 3712680 | 4/1987 | Germany . | |
| 1258761 | 12/1971 | United Kingdom | 242/118.6 |
| 1396641 | 3/1973 | United Kingdom . | |

*Primary Examiner*—Daniel P. Stodola
*Assistant Examiner*—Emmanuel M. Marcelo
*Attorney, Agent, or Firm*—Nixon & Vanderhye P.C.

[57] ABSTRACT

A drum of disposable type to carry a coil of cable or line, for instance, comprising a sleeve and two circular end pieces, each of which is attached to the sleeve by an attachment mechanism at its end portions. Each end piece is provided with a concentric, cylindrical engagement and support flange on the side facing towards the sleeve, the flange having an axial length of 20–50 mm, depending on the diameter of the drum, and being arranged to be received with friction-fit into the interior of the sleeve so that the outside of the flange presses against the inside of the sleeve, the attachment mechanism being arranged within the area of the flange and adjacent end portion of the sleeve so that, in cooperation with the friction engagement of the flange itself, a stable, permanent joint is achieved.

15 Claims, 2 Drawing Sheets

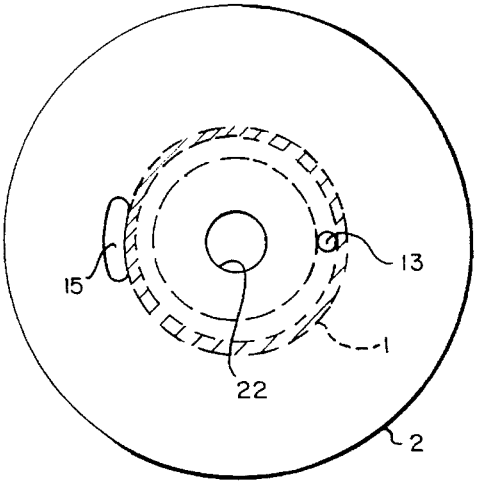
Fig. 3
Fig. 1
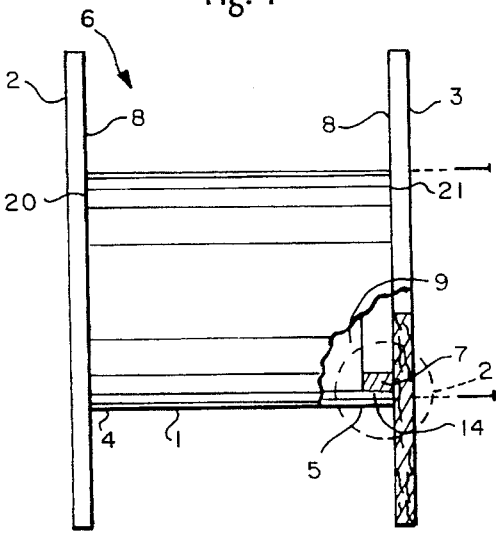
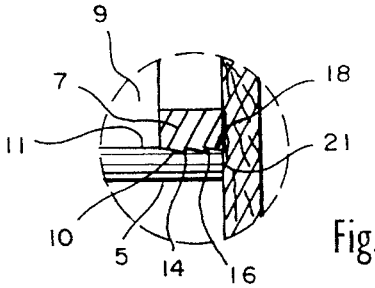
Fig. 2
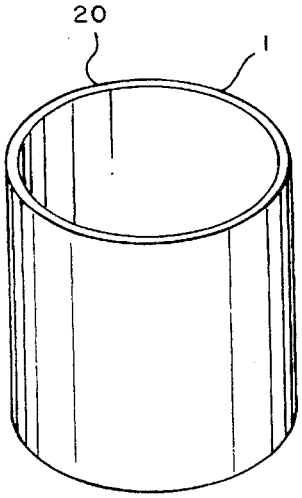
Fig. 4
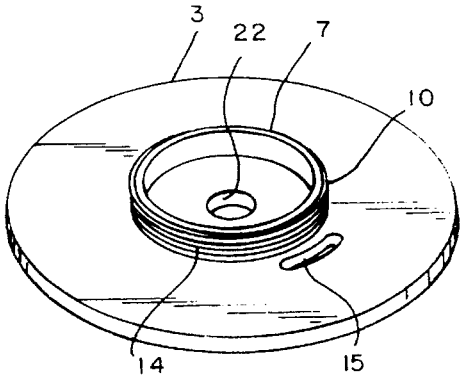
Fig. 5

DISPOSABLE DRUM WITH FRICTION FIT COMPONENTS

FIELD AND BACKGROUND OF THE INVENTION

The present invention relates to a drum of disposable type to carry a coil of a continuous flexible object including cable, line, wire cable, rope, ribbon, hosing, chain or the like.

It is known to use disposable drums with a size of 400 mm, this dimension referring to the diameter of the end pieces. However, the connection between the end pieces and the core in these disposable drums is not strong enough to be used for larger sizes, e.g. 500 mm and 600 mm. Wooden drums of conventional type are therefore still used for these sizes. However, the design of such wooden drums is such that they fetch a high price and must therefore be re-used in order to achieve better economy in handling cable and line. However, the return system operates extremely unsatisfactorily, thereby unfavourably affecting the economy of handling cable and line. Another drawback is that the end pieces of the wooden drum, which are nailed together out of planks, are easily damaged. Damaged wood in the drum may easily damage the cable or line itself when it is uncoiled from the rotating wooden drum, particularly if it runs off the coil in a direction not perpendicular to the axis of rotation of the drum. The damage may be so serious that the entire coil of cable or line, or parts of it, must be rejected. This also results in operating disturbance, i.e. the work in laying cable or line in the field is delayed. Another problem with wooden drums is that their centre of rotation does not usually coincide with that of the sleeve, and therefore not with the central axis of the sleeve. This is extremely unsatisfactory and absolutely unacceptable in the case of opto-cable, for instance, which is very sensitive and easily damaged due to this eccentricity during coiling and uncoiling. Deformations caused by the nature of the wood (not dead material) and errors and complications in the manufacture of the wooden drums contribute to this eccentricity. One suggestion for reducing this problem has been to replace the core of the wooden drum, made of planks, with a sleeve of iron. However, this does not solve all problems and at the same time creates new ones, such as increased weight and cost.

SUMMARY OF THE INVENTION

The object of the invention is to eliminate the above-mentioned problems and provide a disposable drum to replace conventional wooden drums of sizes up to 600 mm (diameter of end pieces).

The present invention relates to a drum of disposable type to carry a coil of a continuous flexible object consisting of cable, line, wire, wire cable, rope, cord, ribbon, hosing, chain or the like, said drum comprising a cylindrical sleeve and two circular end pieces, each of which is attached to the sleeve by at least one attachment means at its end portions which have parallel end surfaces, and has a diameter greater than the diameter of the sleeve thereby forming a space for said coil between the end pieces, said attachment means being free from connecting elements which extend between the end pieces, each of said end pieces being provided with a concentric, cylindrical engagement and support flange on the side facing towards said sleeve, said flange having an axial length of 20–50 mm, depending on the diameter of the drum, and being arranged to be received with friction-fit into the interior of the sleeve so that the outside of the flange presses against the inside of the sleeve, the attachment means being arranged within the area of said flange and adjacent end portion of the sleeve so that, in cooperation with the friction engagement of the flange itself, a stable, permanent joint is achieved between each end piece and sleeve.

BRIEF DESCRIPTION OF THE DRAWINGS

The invention will be described further in the following, with reference to the accompanying drawings.

FIG. 1 is a side view of a disposable drum according to the invention, partially in section, showing the joint between one of the end pieces and the sleeve.

FIG. 2 shows an enlarged part of the joint shown in section in FIG. 1.

FIG. 3 is an end view of a disposable drum according to FIG. 1.

FIG. 4 is a view in perspective of the sleeve forming a part of the disposable drum according to FIG. 1.

FIG. 5 is a view in perspective of an end piece forming a part of the disposable drum according to FIG. 1.

FIG. 1 shows a disposable drum consisting of a non-deformable, cylindrical sleeve 1 and two circular, flat end pieces 2, 3 firmly secured to the sleeve 1 at its end portions 4, 5 facing away from each other. The sleeve 1 has constant, predetermined wall thickness and flat end surfaces 20, 21 perpendicular to the central axis of the sleeve, this axis also coinciding with the axis of rotation of the drum. The diameter of the end pieces 2, 3 is larger than that of the sleeve 1 so that a space 6 is formed between the end pieces for a coil of a continuous object consisting of cable, line, wire, wire cable, rope, cord, ribbon, hosing, chain or similar easily coiled objects. Each end piece is provided with a central aperture 22 to receive the shaft, or two opposing shaft extensions, of equipment for coiling or uncoiling cable or line or some other object of the type stated. According to the invention each end piece 2, 3 comprises a concentric, cylindrical engagement and support flange 7 disposed on its side 8 facing the sleeve 1. The flange 7 is thus integral with the end piece. The flange 7 has an axial length of from 20 mm to 50 mm, depending on the size of the drum, i.e. a larger drum requires an axially longer flange. The outer diameter of the flange 7, measured at the free end surface, corresponds to the inner diameter of the sleeve 1, in order to achieve a favourable friction-fit with the sleeve 1 when the flange 7 is pressed in and received in the space 9 of the sleeve so that the outside 10 of the flange presses against the inside 11 of the sleeve. In order to achieve a permanent joint an attachment means is arranged according to the invention between each end piece 2, 3 and the sleeve 1, cooperating with this friction engagement. This attachment means is free from the element that extends between the end pieces to hold them together, i.e. the permanent joint is effected within the actual area of the initial friction engagement. The attachment means thus excludes axial rods extending through the end pieces and the sleeve which are anchored to the outsides of the end pieces by means of nuts as in the case of the conventional drums. In the embodiment shown the attachment means consists of peripheral protrusions 14 forming sharp edges, located on the outside 10 of the flange 7. Seen in cross section, the protrusions 14 are in the form of saw-teeth or barbs with radial or substantially radial engagement surfaces 16 with surfaces 18 leaning against them. The diameter of each peripheral protrusion 14 is somewhat larger than the inner diameter of the sleeve in order to achieve a favourable penetration effect. When pressed into the sleeve, therefore, the protrusions 14 will penetrate into the sleeve 1 on its inside, as can be seen in FIG. 2, to provide firm engagement and prevent the end piece from being moved away from the sleeve by the forces acting on the drum. Engagement is facilitated by the sleeve, at least at the engagement point, possibly consisting of a slightly softer material than the flange 7. In certain cases it may be suitable or desirable to slightly soften the end portions 4, 5 of the sleeve 1 before the flange 7 is pressed into the sleeve. This can be achieved by wetting the end portions of the sleeve with water. Engagement is then further reinforced when a cable or line or other object is coiled onto the sleeve so that the coil produced increases the engagement pressure against the flange 7 at the end portions 4, 5 of the sleeve. One or both of the end pieces 2, 3 is/are provided with a circular, eccentric hole 13 for a feeder used during uncoiling, and an oval, eccentric hole 15 through which the end of a cable or line is passed for attachment to the drum.

Figure 6:
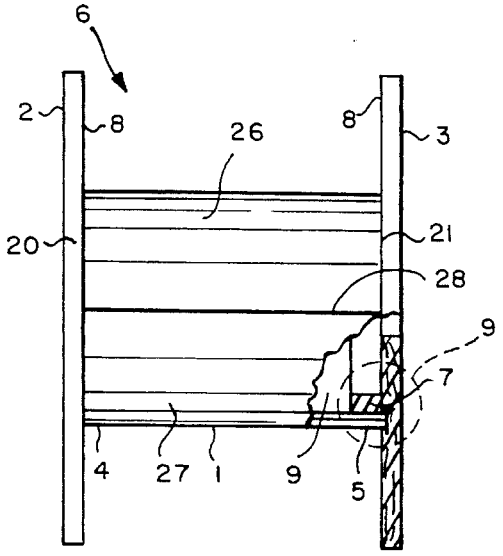
FIG. 6 is a side view of a disposable drum according to another embodiment of the invention, partly in section, showing the joint between one of the end pieces and the sleeve.

The attachment means may also comprise a waterproof adhesive applied to join the contact surfaces on the outside 10 of the flange 7 and the inside 11 of the sleeve 1 and at the inner side 8 of the end piece and the end surface 20, 21 of the sleeve. The adhesive is suitably a waterproof 2-component dispersion glue fulfilling the requirements of DIN 68602 (VTT 1710–80), class B4. Such an adhesive is intended for extreme climate and weather conditions and, according to the norms, shall provide a glue line which will withstand a tensile strength test of at least 4 $N/mm^2$. An example of such adhesives is a polyvinyl acetate type, commercially available under the designation "Kestokol B4+hardener S2".

The attachment means may also consist of nails or screws (as generically represented at element 3 in FIG. 1) driven in axially from the outside of the end piece 2, 3 into the end portions 4, 5 of the sleeve 1 via its end surface 20, 21.

According to another embodiment of the invention the attachment means comprises any combination of the three different attachment means described above, thereby offering four variants.

The outside of the flange may be conically bevelled at its free end portion to facilitate initial insertion of the flange into the sleeve. In the embodiment shown in FIGS. 1 and 2 the outer, inclined surface forms such a bevel.

The sleeve may consist of cardboard, plastic, sheet-metal or wood fibre. The end pieces may consist of plywood, wood fibre such as shavings, or return paper. If plywood is used the flange may consist of cardboard, sheet-metal or plastic, in which case such a flange is anchored to the end piece in suitable manner. If wood fibre or return paper is used, mixtures of materials are mixed with suitable waterproof glue, giving a flange and end piece in one.

Figure 7:
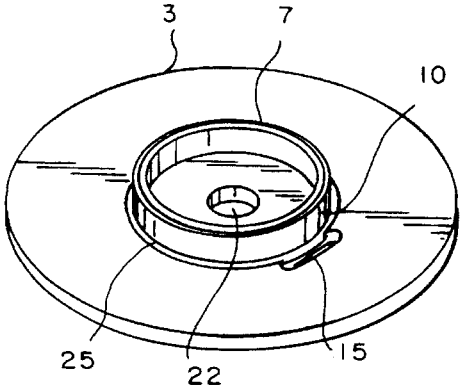
FIG. 7 is a view in perspective of an end piece included in the disposable drum according to FIG. 6.
Figure 9:
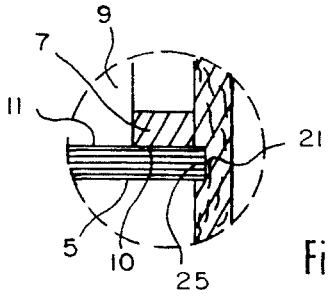
FIG. 9 is an enlargement of the joint shown in section in FIG. 6.

The embodiment shown in FIG. 6 differs form that in FIG. 1 in that each end piece 2, 3 has been provided on its inner side with a concentric peripheral groove 25 located immediately adjacent to and radially outside the flange 7. The groove 25 is arranged to receive an end portion of the sleeve 1 and its width corresponds to the wall thickness of the sleeve. As can be seen more clearly in FIGS. 7 and 9, the flange 7 of the end piece has in this case a smooth outer side 10. The attachment means consists of a waterproof glue or nail/screw or a combination of these to achieve the permanent joint together with the friction engagement obtained when the flange 7 is pressed into the sleeve 1. Alternatively the flange is provided with protrusions like those in the embodiment described first. The depth of the groove 25 is maximally half the thickness of the end piece 2, 3.

Figure 8:
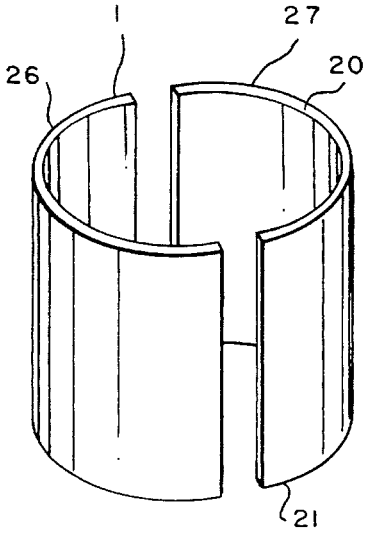
FIG. 8 is a view in perspective of a sleeve in two parts in a disposable drum according to FIG. 6.

FIG. 8 shows a sleeve consisting of two similar cylinder halves 26, 27. Such an axially divided sleeve is used in the drum according to FIG. 6, the groove 25 then providing support for each of the cylinder halves so that these are held together to form a non-deformable sleeve. Alternatively the sleeve is divided only along an axial slit 28. Such a sleeve, slit in one or two places, is advantageous from the storage and transport aspect before the drum is manufactured. The cylinder halves can easily be stacked in each other. Since a sleeve slit axially in one place can be bent out to a certain extent, several such sleeves can be placed one inside the other.

That which is claimed is:

1. A disposable drum for carrying a coil of an elongated easily coiled object, comprising:

a cylindrical sleeve having first and second end surfaces, an outer surface which is adapted to receive a coil and which has an outer diameter, and an inner surface adjacent said end surfaces and having an inner diameter;

first and second circular end pieces having a diameter significantly greater than said outer diameter, so as to define a volume with said outer surface of said sleeve for maintaining an easily coiled object thereon, each said end piece diameter being at least 500 mm;

attachment means for attaching said end pieces to said sleeve at said end surfaces of said sleeve, said attachment means comprising: first and second cylindrical flanges having a diameter approximately the same as said inner diameter, said first flange concentric and integral with said first circular end piece, and extending axially outwardly from said first circular end piece an axial distance of about 20–50 mm; and said second flange concentric and integral with said second circular end piece, and extending axially outwardly from said second circular end piece an axial distance of about 20–50 mm; and said first cylindrical flange having a friction fit with said inner surface of said cylindrical sleeve adjacent said first end surface, and said second cylindrical flange having a friction fit with said inner surface of said cylindrical sleeve adjacent said second end surface, so that a stable joint is provided between said sleeve and said first and second end pieces at said first and second end surfaces of said sleeve, wherein said flanges have non-threaded outer surfaces which form the friction fit with said inner surface of said sleeve, and further comprising at least one peripheral sharp edged protrusion extending outwardly from said outer surface of each of said flanges, engaging said inner surface of said sleeve.

2. A drum as recited in claim 1 wherein said at least one peripheral sharp edged protrusion comprises two protrusions.

3. A drum as recited in claim 2 wherein said cylindrical flanges at each peripheral sharp edged protrusion have a diameter greater than said inner diameter.

4. A drum as recited in claim 2 wherein said end pieces have flat inner and outer major surfaces; and wherein each of said end pieces further comprises a circular groove formed in said flat inner major surface concentric with and immediately radially outside of said flange associated therewith; and wherein each of said end pieces receives an end surface of said sleeve in said groove.

5. A drum as recited in claim 4 wherein said sleeve includes an axial slit extending between said first and second end surfaces thereof.

6. A drum as recited in claim 4 wherein said sleeve includes two axial slits dividing said sleeve into identical halves, each slit extending between said first and second end surfaces of said sleeve.

7. A drum as recited in claim 1 wherein said attachment means further comprises a waterproof adhesive acting between said inner surface of said sleeve and said flanges.

8. A drum as recited in claim 7 wherein each of said cylindrical flanges is integrally connected to an end piece by a groove in said end piece receiving said flange, and a waterproof adhesive acting between said end piece and flange.

9. A drum as recited in claim 1 wherein said attachment means further comprises a plurality of metal fasteners extending through said end pieces into said end surfaces of said sleeve.

10. A drum as recited in claim 1 wherein said end pieces have flat inner and outer major surfaces; and wherein each of said end pieces further comprises a circular groove formed in said flat inner major surface concentric with and immediately radially outside of said flange associated therewith; and wherein each of said end pieces receives an end surface of said sleeve in said groove.

11. A drum as recited in claim 10 wherein said sleeve includes an axial slit extending between said first and second end surfaces thereof.

12. A drum as recited in claim 10 wherein said sleeve includes two axial slits dividing said sleeve into identical halves, each slit extending between said first and second end surfaces of said sleeve.

13. A drum as recited in claim 10 wherein each of said end pieces has a thickness and wherein each of said grooves has a depth; and wherein the depth of each of said grooves is less than one-half the thickness of each of said end pieces.

14. A drum as recited in claim 1 wherein the sleeve is made of cardboard and the end pieces of plywood, and the flanges of plastic.

15. A coil assembly, comprising:

a coil of one of cable, line, wire, wire cable, rope, cord, ribbon, hosing, and chain; and a disposable drum for carrying said coil, said drum comprising: a cylindrical sleeve having first and second end surfaces, an outer surface receiving said coil and which has an outer diameter, and an inner surface adjacent said end surfaces and having an inner diameter; first and second circular end pieces having a diameter significantly greater than said outer diameter, so as to define a volume with said outer surface of said sleeve for maintaining said coil thereon; attachment means for attaching said end pieces to said sleeve at said end surfaces of said sleeve, said attachment means comprising: first and second cylindrical flanges having a diameter approximately the same as said inner diameter, said first flange concentric and integral with said first circular end piece, and extending axially outwardly from said first circular end piece an axial distance sufficient so that a stable friction fit joint is provided between said sleeve and said first end piece at said first end surface of said sleeve; and said second flange concentric and integral with said second circular end piece, and extending axially outwardly from said second circular end piece an axial distance sufficient so that a stable friction fit joint is provided between said sleeve and said second end pieces at said second end surface of said sleeve, wherein said flanges have non-threaded outer surfaces which form the friction fit with said inner surface of said sleeve, and further comprising at least one peripheral sharp edged protrusion extending outwardly from said outer surface of each of said flanges, engaging said inner surface of said sleeve.

* * * * *